US007726332B2

(12) United States Patent
Fiske

(10) Patent No.: US 7,726,332 B2
(45) Date of Patent: Jun. 1, 2010

(54) DURABLE WATER HEATING SYSTEM PROVIDING RAPID HOT WATER DELIVERY

(76) Inventor: Steve Fiske, 10736 Esther Ave., Los Angeles, CA (US) 90064

( * ) Notice: Subject to any disclaimer, the term of this patent is extended or adjusted under 35 U.S.C. 154(b) by 737 days.

(21) Appl. No.: 11/639,742

(22) Filed: Dec. 16, 2006

(65) Prior Publication Data

US 2008/0142089 A1 Jun. 19, 2008

(51) Int. Cl.
*F15D 1/02* (2006.01)
*F16L 53/00* (2006.01)

(52) U.S. Cl. ..... 137/334; 137/337; 251/118; 138/44

(58) Field of Classification Search ..... 137/337, 137/344, 563, 334; 251/118; 138/44, 45, 138/40

See application file for complete search history.

(56) References Cited

U.S. PATENT DOCUMENTS

| | | | | |
|---|---|---|---|---|
| 1,744,842 | A | 1/1930 | Suverkrop et al. | |
| 2,629,403 | A | 2/1953 | Allan | |
| 2,744,429 | A | 5/1956 | Selly | |
| 2,790,463 | A | 4/1957 | Delano et al. | |
| 3,566,902 | A * | 3/1971 | Muller | 138/45 |
| 3,642,030 | A | 2/1972 | Amick | |
| 4,105,049 | A | 8/1978 | Anderson | |
| 4,324,112 | A | 4/1982 | Fujiwara et al. | |
| 5,592,974 | A | 1/1997 | Grohs et al. | |
| 5,829,475 | A * | 11/1998 | Acker | 137/337 |
| 6,131,602 | A | 10/2000 | Oike | |
| 6,357,483 | B1 | 3/2002 | Kobayashi | |
| 6,453,938 | B1 * | 9/2002 | Ebster | 137/337 |
| 6,502,602 | B1 | 1/2003 | Stroup | |
| 6,698,455 | B2 | 3/2004 | Ramirez-Rivera | |
| 6,827,107 | B2 | 12/2004 | Mussler | |
| 6,848,477 | B2 | 2/2005 | Treusch et al. | |
| 6,863,088 | B2 | 3/2005 | Sugiura et al. | |
| 6,991,209 | B2 | 1/2006 | Ball | |
| 2003/0121557 | A1 | 7/2003 | Stroup | |

* cited by examiner

*Primary Examiner*—Kevin L Lee
(74) *Attorney, Agent, or Firm*—David A. Belasco; Belasco Jacobs & Townsley, LLP

(57) ABSTRACT

A durable water heating system providing rapid hot water delivery includes a water heating unit connected to a water source. A hot water line connects the water heating unit to at least one water delivery fixture. A return line of substantially the first cross-section connects to the hot water line adjacent the water delivery fixture located at a greatest distance from the water heating unit. A flow velocity reduction device has a first end, a second end, a first cross-section, an aperture and that extends from the first end to the second end. The aperture and has a second cross-section smaller than the first cross-section. Attachment fittings are provided adjacent the first and second ends. When the device is installed in the return line, velocity of water circulating through the system will be substantially reduced, thereby reducing wear on the system while providing rapid hot water delivery at the fixture.

12 Claims, 4 Drawing Sheets

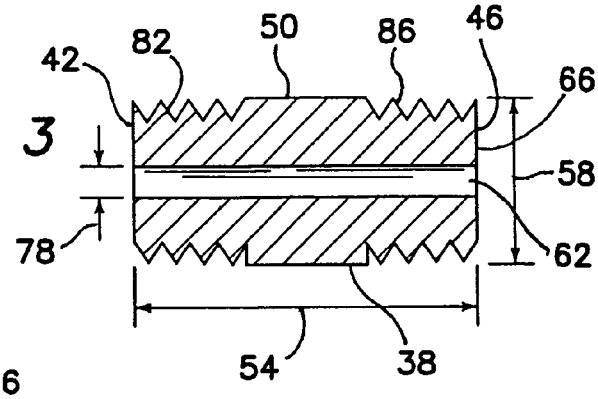
FIG. 3
FIG. 11
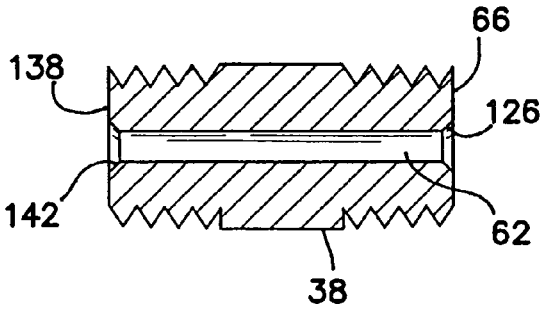
FIG. 12
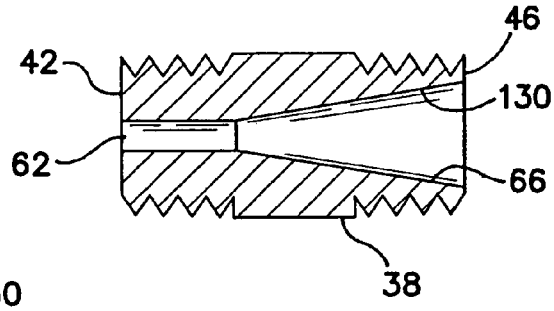
FIG. 13
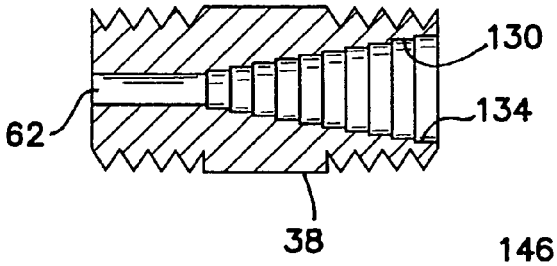
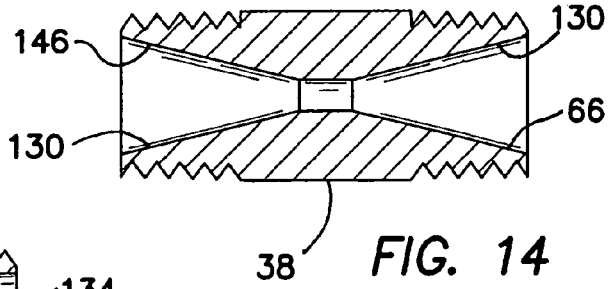
FIG. 14
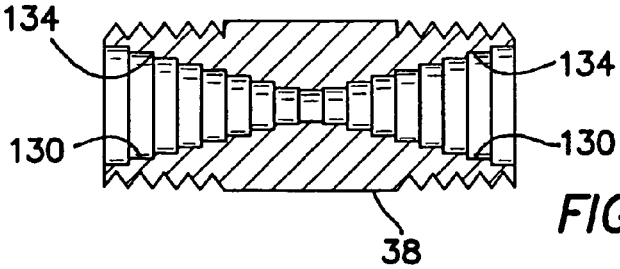
FIG. 15

DURABLE WATER HEATING SYSTEM PROVIDING RAPID HOT WATER DELIVERY

FIELD OF INVENTION

The invention pertains to water heating systems. More particularly, the invention relates to devices and methods for preventing excessive wear in hot water circulating systems.

BACKGROUND OF THE INVENTION

As houses and apartment buildings become larger, often the distance from a hot water heater to points of end use, such as showers and faucets, becomes longer. As a result, system users may have to wait several minutes for hot water after turning on a faucet or shower. As this is both wasteful of water and annoying to the users, systems have been developed to circulate the water heated by the water heater so that hot water will be quickly available at remote end use points. Unfortunately these recirculating systems often result in water moving constantly through the pipes. Such movement tends to cause unnecessary wear on the pipes through abrasion, resulting in leaks, often in inconvenient locations. The present invention attempts to solve this problem by slowing the flow of water through hot water circulating systems.

U.S. Pat. No. 6,502,602, and U.S. Patent Application No. 2003/0121557 both by Stroup, are directed to a flow valve, a fixed control device that can be machined to provide a reliable restriction to limit a flow to a predetermined value at a given applied pressure. The flow valve can be used for reliably testing compressors without the need for recalibration between tests. The device has threads at each end for coupling the valve into the compressor test set-up. The valve can be provided with flats at the center portion for engagement by wrenches. The control device is shown with a bore that tapers from a large diameter at the entrance to a smaller diameter at the exit, though an embodiment can be provided with the bore tapered at both ends.

U.S. Pat. No. 1,744,842, issued to Suverkrop et al is directed to a flow nipple used in oil wells to reduce the flow of oil without causing eddy currents. The flow nipple is a short length of pipe threaded at both ends and has a decreased diameter of the flow path in the pipe. The diameter of the bore is large at each end of the pipe and gradually decreases in diameter toward the center. The decrease in diameter can be any smooth curve like a sine wave. The smooth curve will reduce the flow without causing eddy currents.

U.S. Pat. No. 2,790,463, issued to Delano et al illustrates a flow regulator that can be inserted in the fluid conduits to regulate the flow of a drinking fountain. The flow regulator formed from a single piece has a cylindrical body with external threads formed at each end for cooperation with stand pipe fittings of the proper size. The fluid path through the cylindrical body is a bore that starts out with a tapered feed-in leaving to four consecutive bores with the first being narrow and the subsequent ones of greater diameter. The Venturi-like formation opening into the compartments of increasing size provides a drag or friction on the flow of water, thus eliminating spurting at the fountain.

U.S. Pat. No. 5,592,974, issued to Grohs et al. discloses an apparatus for limiting the volume of fluid flowing from an automotive hose into a heat exchanging device in an automotive heating or air-conditioning system. The restrictor includes a generally cylindrical, hollow body disposed in the hose and a flow limiting washer disposed in the body. The body includes an annular wall having a stepped region of reduced cross-sectional area which receives a hose clamp therein to prevent sliding and rotation of the restrictor within the hose.

U.S. Pat. No. 6,698,455, issued to Ramirez-Rivera is directed to a fluid flow rate economizing device having a tubular body and a reduction in the inner diameter, suitable to install inside residential, commercial or industrial hydraulic tubing at fluid intakes, meters and/or registers U.S. Pat. No. 4,105,049, issued to Anderson discloses an abrasive resistant choke assembly. It is especially for use in withstanding the abrasive action of sharp particles of silt and sand that are carried by hot fluids flowing under pressure from producing wells. It includes a choke passage with an inlet end that has an angle of taper of less than 8.degree.

It is an objective of the present invention to provide a device to reduce the velocity of water circulating through a hot water circulating system. It is a further objective to provide a device that will reduce wear on the pipes of the circulating system. It is a still further objective of the invention to provide a device that is easily installed in existing circulating system. It is yet a further objective of the invention that the device can be properly installed in any orientation and provide the desired functionality. Finally, it is an objective of the present invention to provide such a device that is readily identified in the system once installed, easily removed, and that can be easily and inexpensively manufactured.

While some of the objectives of the present invention are disclosed in the prior art, none of the inventions found include all of the requirements identified.

SUMMARY OF THE INVENTION

The present invention addresses all of the deficiencies of prior art water heating systems providing rapid hot water delivery inventions and satisfies all of the objectives described above.

(1) A durable water heating system providing rapid hot water delivery providing the desired features may be constructed from the following components. A water heating unit is provided. The water heating unit is connected to a water source and heats water to a designated temperature. At least one hot water line is provided. The hot water line connects the water heating unit to at least one water delivery fixture. A hot water return line is provided. The return line connects to the at least one hot water line adjacent one of the at least one water delivery fixtures. The fixture is located at a greatest distance from the water heating unit.

A flow velocity reduction device is provided. The device has a first end, a second end, an outer surface, a first predetermined length, a first predetermined cross-section, an aperture and at least one barrier surface located adjacent at least one of the first and second ends. The aperture extends from the first end to the second end and has a second predetermined cross-section smaller than the first predetermined cross-section for at least a portion of its length. First and second attachment fittings are provided. The fittings are located adjacent the first and second ends. When the flow velocity reduction device is installed as part of the return line and the return line has substantially the first predetermined cross-section, velocity of water circulating through the return line will be substantially reduced, thereby reducing wear on the water heating system while providing rapid hot water delivery at the at least one water delivery fixture.

(2) In a variant of the invention, the flow velocity reduction device includes a turning fixture. The turning fixture is located on the outer surface of the device between the first end and the second end.

(3) In another variant, the turning fixture is selected from the group consisting of wrench flats, knurling and friction grooves.

(4) In still another variant, the first and second attachment fittings are selected from the group consisting of external threads, internal threads, flare nut fittings, compression fittings and sweat fittings.

(5) In yet another variant, the aperture in the device is cylindrical.

(6) In a further variant, the at least one barrier surface is orthogonal to the outer surface with the aperture passing through it.

(7) In still a further variant, the at least one barrier surface has a chamfered inlet to the aperture.

(8) In yet a further variant, the at least one barrier surface is in the form of a frustrated cone, the cone extending from the first end inwardly toward the second end and connecting to the aperture.

(9) In another variant of the invention, the cone has a stepped inner surface.

(10) In still another variant, the flow velocity reduction device further includes a second barrier surface at the second end, the second barrier surface has a second chamfered inlet to the aperture, thereby permitting installation of the device in either of two orientations.

(11) In yet another variant, the flow velocity reduction device further includes a second barrier surface in the form of a frustrated cone at the second end. The cone extends from the second end inwardly toward the first end and connects to the aperture, thereby permitting installation of the device in either of two orientations.

(12) In a further variant, at least one of the cones has a stepped inner surface.

An appreciation of the other aims and objectives of the present invention and an understanding of it may be achieved by referring to the accompanying drawings and the detailed description of a preferred embodiment.

DESCRIPTION OF THE DRAWINGS

FIG. 3 is a side cross-sectional view of the FIG. 2 embodiment;

FIG. 11 is a side cross-sectional view of the FIG. 2 embodiment illustrating orthogonal barrier surfaces and chamfered aperture inlets;

FIG. 12 is a side cross-sectional view of the FIG. 2 embodiment illustrating a frustrated cone barrier surface;

FIG. 13 is a side cross-sectional view of the FIG. 2 embodiment illustrating a stepped frustrated cone barrier surface;

FIG. 14 is a side cross-sectional view of the FIG. 2 embodiment illustrating dual frustrated cone barrier surfaces; and FIG. 15 is a side cross-sectional view of the FIG. 2 embodiment illustrating dual stepped frustrated cone barrier surfaces.

DETAILED DESCRIPTION OF THE PREFERRED EMBODIMENT (1) FIG. 1 illustrates a durable water heating system providing rapid hot water delivery 10 providing the desired features that may be constructed from the following components. A water heating unit 14 is provided. The water heating unit 14 is connected to a water source 18 and heats water 22 to a designated temperature. At least one hot water line 26 is provided. The hot water line 26 connects the water heating unit 14 to at least one water delivery fixture 30. A hot water return line 34 is provided. The return line 34 connects to the at least one hot water line 26 adjacent one of the at least one water delivery fixtures 30. The fixture 30 is located at a greatest distance from the water heating unit 14.

Figure 1:
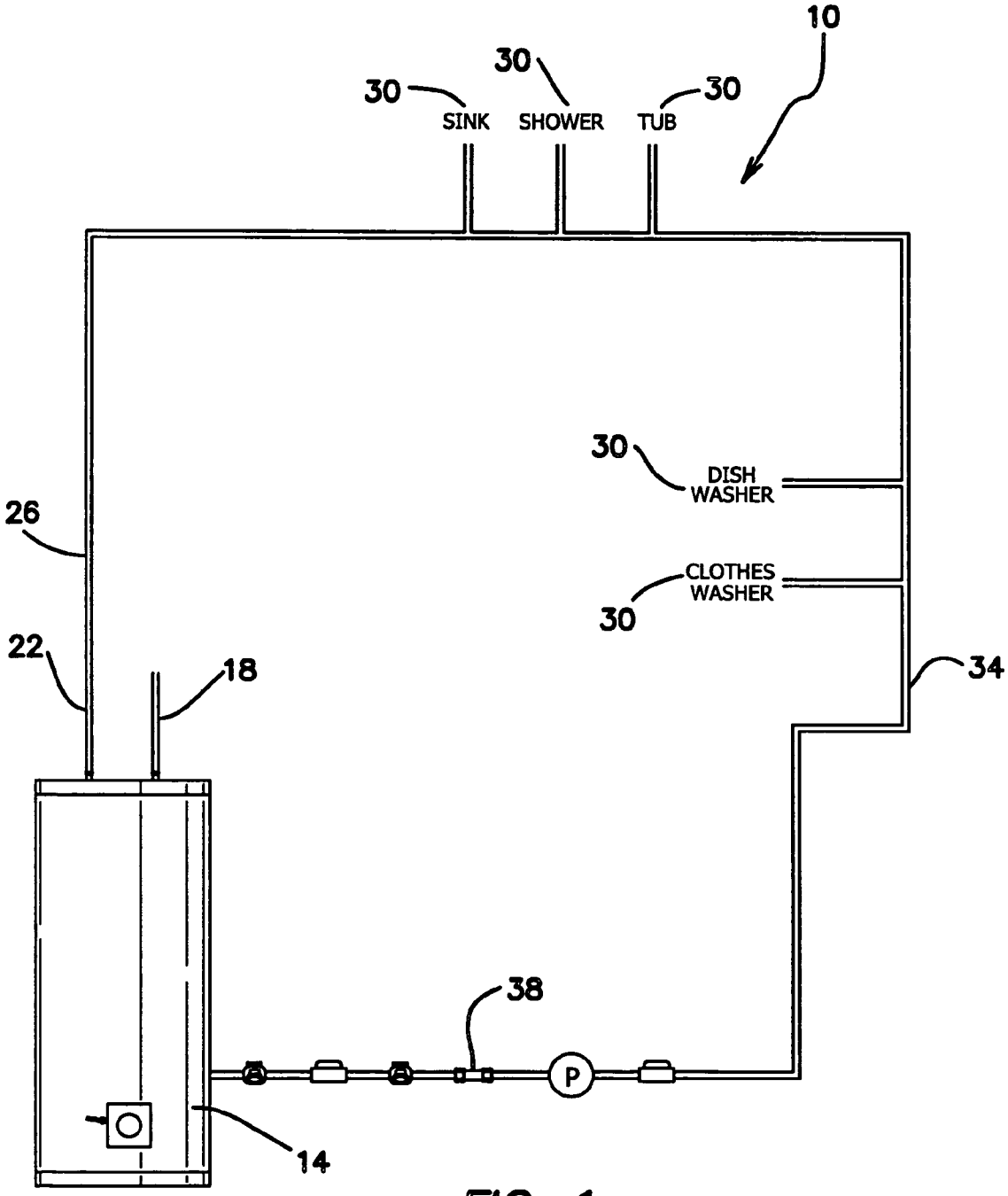
FIG. 1 is a schematic view of the preferred embodiment of the invention illustrating the appropriate placement of a flow velocity reduction device in a hot water recirculating system.
Figure 2:
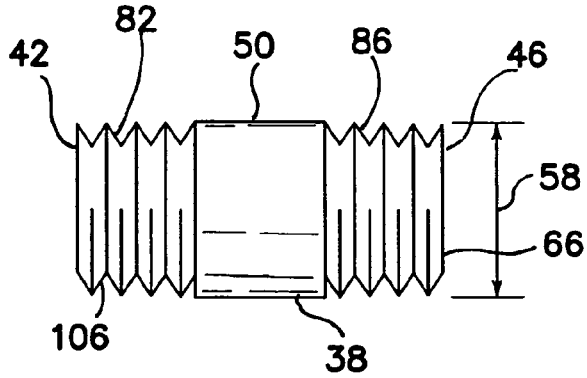
FIG. 2 is a side elevational view of the flow velocity reduction device of the FIG. 1 embodiment.

A flow velocity reduction device 38, as illustrated in FIGS. 2-15, is provided. The device 38 has a first end 42, a second end 46, an outer surface 50, a first predetermined length 54, a first predetermined cross-section 58, an aperture 62 and at least one barrier surface 66 located adjacent at least one of the first 42 and second 46 ends. The aperture 62 extends from the first end 42 to the second end 46 and has a second predetermined cross-section 78 smaller than the first predetermined cross-section 58 for at least a portion of its length 54. First 82 and second 86 attachment fittings are provided. The fittings 82, 86 are located adjacent the first 42 and second 46 ends. When the flow velocity reduction device 38 is installed as part of the return line 34 and the return line 34 has substantially the first predetermined cross-section 58, velocity of water 22 circulating through the return line 34 will be substantially reduced, thereby reducing wear on the water heating system 10 while providing rapid hot water delivery at the at least one water delivery fixture 30.

Figure 4:
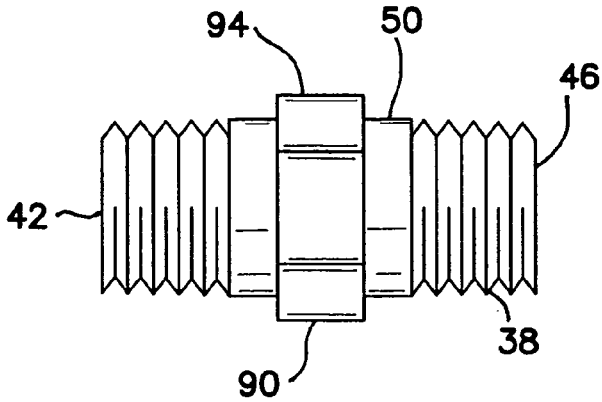
FIG. 4 is a side elevational view of the FIG. 2 embodiment illustrating wrench flats as a turning fixture.
Figure 5:
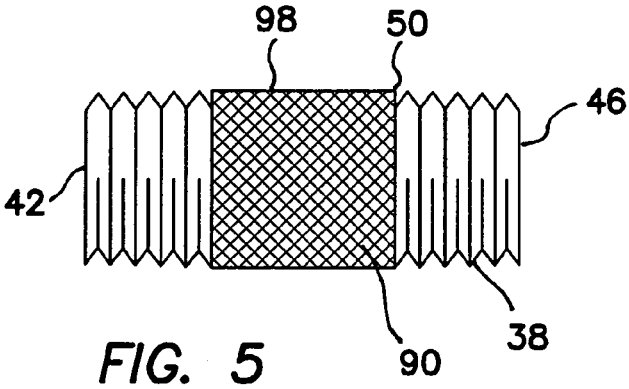
FIG. 5 is a side elevational view of the FIG. 2 embodiment illustrating knurling as a turning fixture.
Figure 6:
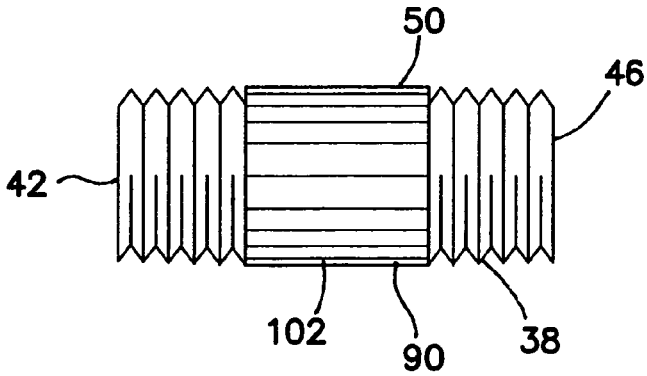
FIG. 6 is a side elevational view of the FIG. 2 embodiment illustrating friction grooves as a turning fixture.
Figure 7:
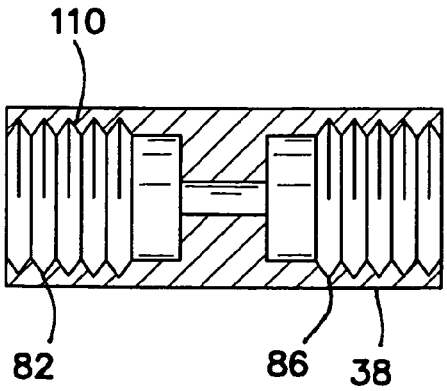
FIG. 7 is a side cross-sectional view of the FIG. 2 embodiment illustrating internal threads as attachment fittings.
Figure 8:
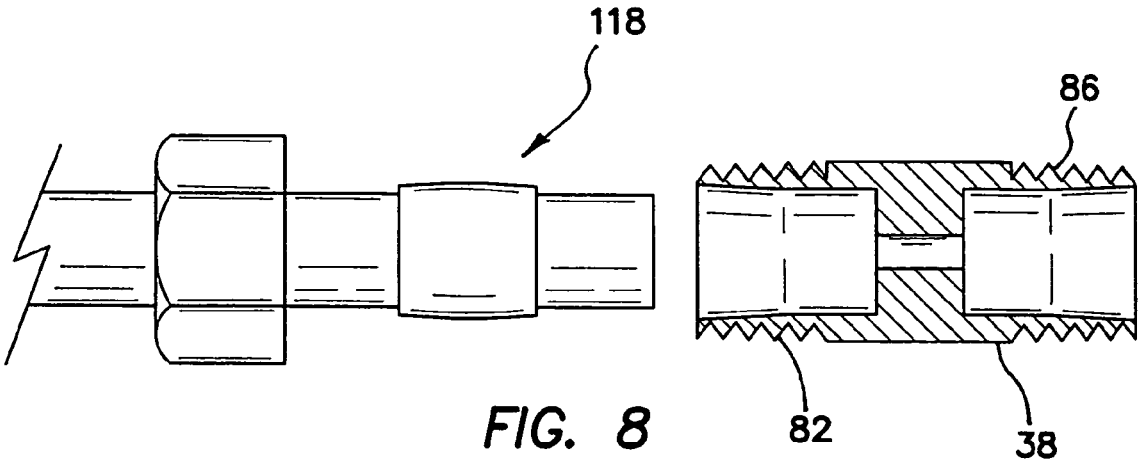
FIG. 8 is a side cross-sectional view of the FIG. 2 embodiment illustrating a compression fitting as an attachment fitting.
Figure 9:
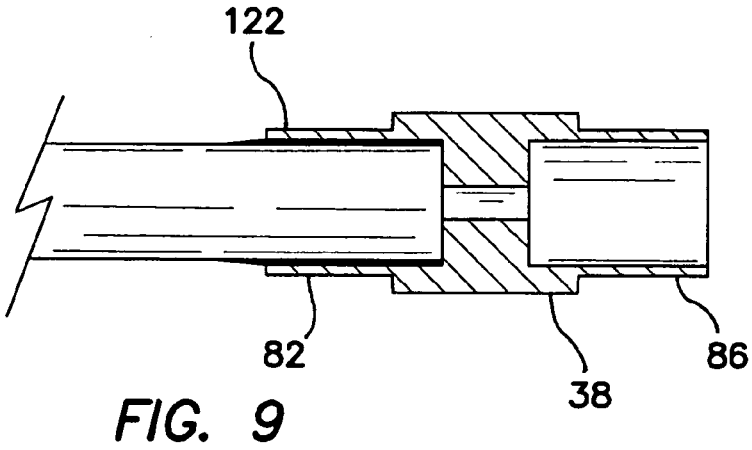
FIG. 9 is a side cross-sectional view of the FIG. 2 embodiment illustrating sweat fittings as attachment fittings.
Figure 10:
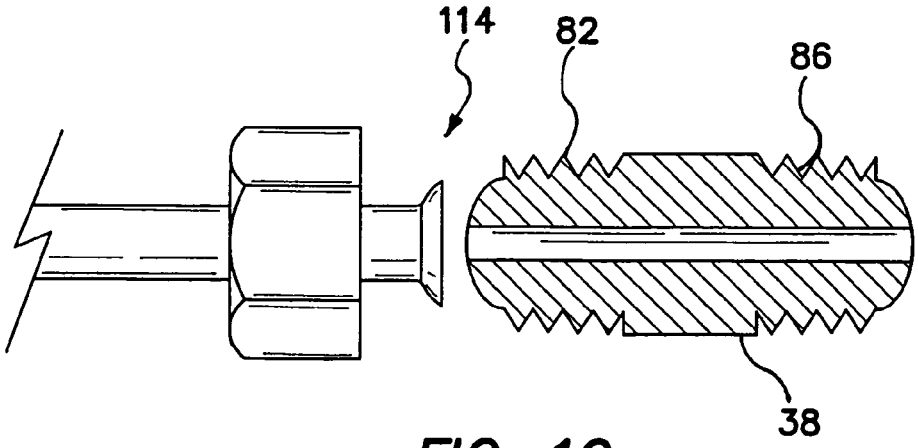
FIG. 10 is a side cross-sectional view of the FIG. 2 embodiment illustrating a flare nut fitting as an attachment fitting.

(2) In a variant of the invention, as illustrated in FIGS. 4-6, the flow velocity reduction device 38 includes a turning fixture 90. The turning fixture 90 is located on the outer surface 50 of the device 38 between the first end 42 and the second end 46.

(3) In another variant, the turning fixture 90 is selected from the group consisting of wrench flats 94, knurling 98 and friction grooves 102.

(4) In still another variant, as illustrated in FIGS. 2 and 7-10, the first 82 and second 86 attachment fittings are selected from the group consisting of external threads 106, internal threads 110, flare nut fittings 114, compression fittings 118 and sweat fittings 122.

(5) In yet another variant, as illustrated in FIG. 3, the aperture 62 in the device is cylindrical.

(6) In a further variant, the at least one barrier surface 66 is orthogonal to the outer surface 50 with the aperture 62 passing through it.

(7) In still a further variant, as illustrated in FIG. 11, the at least one barrier surface 66 has a chamfered inlet 126 to the aperture 62.

(8) In yet a further variant, as illustrated in FIG. 12, the at least one barrier surface 66 is in the form of a frustrated cone 130, the cone 130 extending from the first end 42 inwardly toward the second end 46 and connecting to the aperture 62.

(9) In another variant of the invention, as illustrated in FIG. 13, the cone 130 has a stepped inner surface 134.

(10) In still another variant, as illustrated in FIG. 11, the flow velocity reduction device 38 further includes a second barrier surface 138 at the second end 46, the second barrier surface 138 has a second chamfered inlet 142 to the aperture 62, thereby permitting installation of the device 38 in either of two orientations.

(11) In yet another variant, as illustrated in FIG. 14, the flow velocity reduction device 38 further includes a second barrier surface 146 in the form of a frustrated cone 130 at the second end. The cone 130 extends from the second end 46 inwardly toward the first end 42 and connects to the aperture 62, thereby permitting installation of the device 38 in either of two orientations.

(12) In a final variant, as illustrated in FIG. 15, at least one of the cones 130 has a stepped inner surface 134.

The durable water heating system providing rapid hot water delivery 10 has been described with reference to particular embodiments. Other modifications and enhancements can be made without departing from the spirit and scope of the claims that follow.

The invention claimed is:

1. A durable water heating system providing rapid hot water delivery, comprising:

a water heating unit, said water heating unit connected to a water source and heating water to a designated temperature;

at least one hot water line, said hot water line connecting said water heating unit to at least one water delivery fixture;

a hot water return line, said return line connecting to said at least one hot water line adjacent one of said at least one water delivery fixtures, said fixture disposed at a greatest distance from said water heating unit, said greatest distance being greater than a distance along said hot water line of any other of said water delivery fixtures from said water heating unit;

a flow velocity reduction device, said device having a first end, a second end, an outer surface, a first predetermined length, a first predetermined cross-section, an aperture and at least one barrier surface disposed adjacent at least one of said first and second ends;

said aperture extending from said first end to said second end and having a second predetermined cross-section smaller than said first predetermined cross-section for at least a portion of its length;

first and second attachment fittings, said fittings disposed adjacent said first and second ends; and whereby, when said flow velocity reduction device is installed as part of said return line, said return line having substantially said first predetermined cross-section, velocity of water circulating through said return line will be substantially reduced, thereby reducing wear on said water heating system while providing rapid hot water delivery at said at least one water delivery fixture.

2. The durable water heating system providing rapid hot water delivery, as described in claim 1, wherein said flow velocity reduction device further comprises a turning fixture, said turning fixture being disposed on said outer surface of said device between said first end and said second end.

3. The durable water heating system providing rapid hot water delivery, as described in claim 2, wherein said turning fixture is selected from the group consisting of:

wrench flats, knurling and friction grooves.

4. The durable water heating system providing rapid hot water delivery, as described in claim 1, wherein said first and second attachment fittings are selected from the group consisting of:

external threads, internal threads, flare nut fittings, compression fittings and sweat fittings.

5. The durable water heating system providing rapid hot water delivery, as described in claim 1, wherein said aperture in said device is cylindrical.

6. The durable water heating system providing rapid hot water delivery, as described in claim 1, wherein said at least one barrier surface is orthogonal to said outer surface with said aperture passing therethrough.

7. The durable water heating system providing rapid hot water delivery, as described in claim 1, wherein said at least one barrier surface has a chamfered inlet to said aperture.

8. The durable water heating system providing rapid hot water delivery, as described in claim 1, wherein said at least one barrier surface is a frustrated cone, said cone extending from said first end inwardly toward said second end and connecting to said aperture.

9. The durable water heating system providing rapid hot water delivery, as described in claim 8, wherein said cone has a stepped inner surface.

10. The durable water heating system providing rapid hot water delivery, as described in claim 7, wherein said flow velocity reduction device further comprises a second barrier surface at said second end, said second barrier surface having a second chamfered inlet to said aperture, thereby permitting installation of said device in either of two orientations.

11. The durable water heating system providing rapid hot water delivery, as described in claim 8, wherein said flow velocity reduction device further comprises a second barrier surface that is a frustrated cone at said second end, said cone extending from said second end inwardly toward said first end and connecting to said aperture, thereby permitting installation of said device in either of two orientations.

12. The durable water heating system providing rapid hot water delivery, as described in claim 11, wherein at least one of said cones has a stepped inner surface.

* * * * *